US006733566B1

(12) United States Patent
Fang et al.

(10) Patent No.: US 6,733,566 B1
(45) Date of Patent: May 11, 2004

(54) PETROLEUM COKE MELT COVER FOR ALUMINUM AND MAGNESIUM ALLOYS

(75) Inventors: Que-Tsang Fang, Export, PA (US); Jen C. Lin, Export, PA (US); Timothy A. Kuhn, Frederick, MD (US); Holger Haddenhorst, Gelsenkirchen (DE)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/457,269

(22) Filed: Jun. 9, 2003

(51) Int. Cl.[7] ..... C22B 21/06; C22B 26/22

(52) U.S. Cl. ..... 75/709; 75/604; 75/684; 164/55.1; 164/123; 420/590

(58) Field of Search ..... 75/709, 604, 684; 420/590; 164/55.1, 123

(56) References Cited

U.S. PATENT DOCUMENTS

| | | | | |
|---|---|---|---|---|
| 4,157,728 A | | 6/1979 | Mitamura et al. | |
| 4,377,425 A | | 3/1983 | Otani et al. | |
| 4,533,386 A | * | 8/1985 | Kibby | 75/10.27 |
| 5,094,289 A | | 3/1992 | Gentry | |
| 5,215,143 A | | 6/1993 | Gentry | |
| 5,415,220 A | | 5/1995 | Edwards | |
| 5,421,856 A | | 6/1995 | Lascano-Navarro | |
| 5,469,911 A | | 11/1995 | Parker | |
| 6,024,779 A | | 2/2000 | Snell | |
| 6,485,541 B1 | | 11/2002 | Hryn et al. | |

* cited by examiner

*Primary Examiner*—Melvyn Andrews
(74) *Attorney, Agent, or Firm*—Gary A. Nitowski; Tracey D. Beiriger

(57) ABSTRACT

A method for preventing oxidation of molten aluminum alloy and magnesium alloy surfaces, the method comprising providing a molten aluminum alloy or magnesium alloy having a molten aluminum or magnesium alloy surface; covering the molten aluminum or magnesium alloy surface with an initial layer of petroleum coke, the initial layer of petroleum coke having an initial layer thickness of about 0.75 inches; oxidizing a portion of the initial layer of petroleum coke to form a working layer of petroleum coke covering the molten metal surface, the working layer of coke having a working layer thickness of about 0.5 inches, and a layer of carbon dioxide immediately adjacent to and contiguous with the working layer of petroleum coke; and adding additional petroleum coke to the working layer of petroleum coke to maintain the working layer thickness at about 0.5 inches.

30 Claims, 4 Drawing Sheets

PETROLEUM COKE MELT COVER FOR ALUMINUM AND MAGNESIUM ALLOYS

FIELD OF THE INVENTION

The instant invention relates to a method of preventing metal loss due to oxidation in molten aluminum and magnesium alloys. Specifically, covering the molten alloy surface with a layer of petroleum coke, which subsequently oxidizes at high temperatures to form a layer of carbon dioxide that insulates the alloy melt from ambient air oxygen, significantly reduces metal loss from the molten alloys due to oxidation.

BACKGROUND OF THE INVENTION

Many metals and metal alloys, used especially in the foundry industries, suffer from loss of metal due to oxidation while in the molten state ("melt" for brevity). This is particularly true for many aluminum-magnesium alloys. Significant and costly magnesium weight loss in the melt can be experienced. This leads to difficulty in controlling alloy composition, which is required to meet mechanical property specifications of the solidified alloy. As magnesium in the melt is depleted by loss to oxidation, magnesium concentration in the melt needs to be monitored and restored to desired levels by new magnesium additions.

Further, the significant metal weight loss in the melt due to oxidation results in the formation of dross on the surface of the melt, and oxide inclusions in the melt. Dross, as used herein, refers to undesirable oxides that form on the surface of a melt. Prior to casting the alloy, dross must be skimmed off of the melt surface, and disposed of in landfills. Oxide inclusions result in degradation of mechanical properties, such as ultimate tensile and yield strengths, of the alloys.

Previous methods that are employed to limit metal melt oxidation attempted to either blanket the melt in an atmosphere of inert gas, thus preventing oxidation of the melt surface, or to cover the melt surface with a solid inert barrier material that could physically prevent oxygen in the furnace atmosphere from reacting with the melt surface.

U.S. Pat. No. 6,024,779 describes a means to minimize oxidation of copper melts. Carbon sand, consisting of coke particles, is layered on top of a copper melt in thicknesses from about 1 millimeter to about 4 inches to prevent oxidation of the melt. The carbon sand forms a protective layer over copper and copper alloy melts and can be re-used. U.S. Pat. No. 6,485,541 teaches a method to reduce oxidation of aluminum melts. Inert refractory material is allowed to float on the melt, thus isolating the melt from oxygen in the air. U.S. Pat. No. 5,415,220 teaches the use of a salt covering for DC casting aluminum-lithium alloys. A mixture of lithium chloride and potassium chloride is preferred. The need for an inert atmosphere is obviated by use of the salt cover. U.S. Pat. No. 5,421,856 discloses the use of gas injectors in the melt that utilize inert gases to remove oxygen from the atmosphere above the melt.

Using an inert atmosphere to minimize oxidation requires specialized furnaces that seek to maintain an inert atmosphere directly above the melt surface. Such furnaces are costly to install, to maintain, and to use. However, the exclusion of practically all of the oxygen from the furnace atmosphere provides for low oxide formation.

Placing physical barriers on the melt surface allows for the use of ordinary furnaces that operate in ambient air. However, because of the high thermodynamic driving force for the reaction of certain metals, such as aluminum and magnesium, with oxygen, it is difficult to eliminate oxide formation simply by using physical barriers.

Accordingly, it would be advantageous to have an economical process that would combine the efficiency of inert atmosphere with the economy and the facility of using a physical barrier.

In addition to magnesium metal loss due to oxidation and general dross formation, it is well known in the aluminum alloy casting art that melt surface oxidation can result in various surface imperfections in cast ingots such as pits, vertical folds, oxide patches and the like, which can develop into cracks during casting or in later processing. A crack in an ingot or slab propagates during subsequent rolling, for example, leading to expensive remedial rework or scrapping of the cracked material.

The casting of alloys may be done by any number of methods known to those skilled in the art, such as direct chill casting (DC), electromagnetic casting (EMC), horizontal direct chill casting (HDC), hot top casting, continuous casting, semi-continuous casting, die casting, roll casting and sand casting. Each of these casting methods has a set of its own inherent problems, but with each technique, surface imperfections can still be an issue. One mechanical means of removing surface imperfections from an aluminum alloy ingot is scalping. Scalping involves the machining off a surface layer along the sides of an ingot after it has solidified.

Certain alloys, such as 7050 and other 7xxx alloys as well as 5182 and 5083 are especially prone to surface defects and cracking. In the past, beryllium has been added, usually at part per million (ppm) levels to some of these alloys to control melt surface defects, and to prevent magnesium loss due to oxidation. However, beryllium has been banned from aluminum products used for food and beverage packaging. Further, there have been increased concerns over the health risks associated with factory workers using beryllium and products containing beryllium. For this reason, although beryllium is effective at controlling surface defects and melt surface oxidation in aluminum cast ingots, a suitable replacement is needed.

U.S. Pat. No. 5,469,911 to Parker discloses a method for improving the surface quality of electromagnetically cast aluminum alloy ingots, which includes the addition of 0.01 to 0.04 wt. % calcium prior to the ingot head of an ingot mold. These levels of calcium are significantly higher than the ppm levels employed with beryllium. Such high levels of calcium can adversely affect the properties of the alloy.

U.S. Pat. No. 4,377,425 to Otani et al. discloses using calcium in high iron containing direct chill cast aluminum alloy ingots to minimize the occurrence of dendritic or so-called "fir tree" crystal structures with a grain size of less than 150 microns. This method was particularly useful for AA1000 and AA5000 series aluminum alloys. The effect, if any, of calcium on the surface quality of the resulting ingots was not disclosed by Otani et al.

There remains a need for an effective alternative to beryllium to prevent surface imperfections, such as vertical folds, pits, oxide patches and the like from forming during aluminum ingot casting, and to prevent melt surface oxidation. Such a method would be instrumental in preventing cracks, which can form during casting or can develop in later processing. Finally, the method preferably would have no adverse affect on alloy properties.

The primary object of the present invention is to provide an economical and efficient method for minimizing metal loss due to oxide formation on an aluminum alloy or magnesium alloy melt surface in furnaces operating in ambient air.

Another object of the present invention is to provide an in situ method of generating an inert atmosphere above an aluminum alloy or magnesium alloy melt surface without the requirement of specialized furnaces that are adapted to displace oxygen during operation.

A further object of the present invention is to provide a method of minimizing oxide formation on an aluminum alloy or magnesium alloy melt surface with the method having the efficiency of using an inert atmosphere and the facility of using a physical barrier placed on the melt surface.

Yet another object of the present invention is to provide a method to minimize dross formation on an aluminum alloy or magnesium alloy melt surface.

Still another object of the present invention is to provide a method to minimize oxide inclusions in an aluminum alloy or magnesium alloy solid, thereby maximizing the mechanical properties of that solid.

Still a further objective to this invention is to provide an effective alternative to beryllium alloying additions to aluminum alloys or magnesium alloys for the prevention of surface imperfections such as vertical folds, pits, oxide patches and the like from forming during aluminum ingot casting.

These and other objects and advantages are met or exceeded by the instant invention, and will become more fully understood and appreciated with reference to the following description.

SUMMARY OF THE INVENTION

The instant invention provides a combination of a physical barrier and an inert atmosphere, which is effective in minimizing oxide formation in ordinary furnaces. As a result, dross formation is minimized and mechanical properties of the resultant metallic solid product are maximized. The method is intended for use in ordinary furnaces, which contain ambient air, and require no special gas handling equipment.

In a preferred embodiment, petroleum coke, also known in the art as carbon flake, is added to a melt surface to completely cover the melt surface with an initial layer thickness of about 0.125 inch to about 5 inch. In a more preferred embodiment the petroleum coke initial layer thickness is about 0.25 inch to about 3 inch. In a most preferred embodiment the petroleum coke initial layer thickness is about 0.5 inch to about 1 inch. At typical melt temperatures, in furnaces that are open to ambient air, the petroleum coke layer will immediately begin to oxidize with oxygen in the furnace air to form, in situ, an inert atmosphere of carbon dioxide gas, with the partial pressure of the carbon dioxide gas being highest at the petroleum coke/air interface. Diffusion of oxygen molecules from the furnace air through the high partial pressure of carbon dioxide at the petroleum coke/air interface becomes arduous. Oxygen that does diffuse through the in situ generated carbon dioxide layer is further inhibited from reaching the melt by being consumed in the reaction with the petroleum coke. An equilibrium will be established that governs the rate of petroleum coke consumption and in-situ carbon dioxide generation.

Conceptually, at the point where the reaction of petroleum coke with oxygen to form carbon dioxide gas reaches equilibrium, the petroleum coke layer is now referred to as a working layer. Practically, the working layer is attained immediately after adding the initial layer of petroleum coke. The petroleum coke working layer is monitored periodically. In a preferred embodiment the working layer thickness is maintained in the range of about 0.125 inch to about 5 inch by adding petroleum coke. In a more preferred embodiment the petroleum coke working layer thickness is maintained in the range of about 0.25 inch to about 3 inch by adding petroleum coke. In a most preferred embodiment the petroleum coke working layer thickness is maintained in the range of about 0.5 inch to about 1 inch by adding petroleum coke. Preferably, the petroleum coke layer is checked and maintained about every 6 to 12 hours. More preferably the petroleum coke layer is checked about ever 8 to 10 hours.

Maintaining a working layer of petroleum coke is important for the instant invention in that it is not only required for continued generation of a high partial pressure of inert carbon dioxide that protects the melt from oxidation, but also for providing a physical barrier that blocks the diffusion of any unreacted oxygen through the working petroleum coke layer.

If the molten metal is transferred from the furnace to a crucible, the working layer of petroleum coke does not need to be removed prior to metal transfer. The petroleum coke can remain on the melt surface through rotor or lance crucible degassing, if applicable.

For cast pouring, whether from a dip well of from a crucible, the working layer of petroleum coke must be skimmed from the melt surface prior to ladling the casting metal.

DETAILED DESCRIPTION OF PREFERRED EMBODIMENTS

Figure 1:
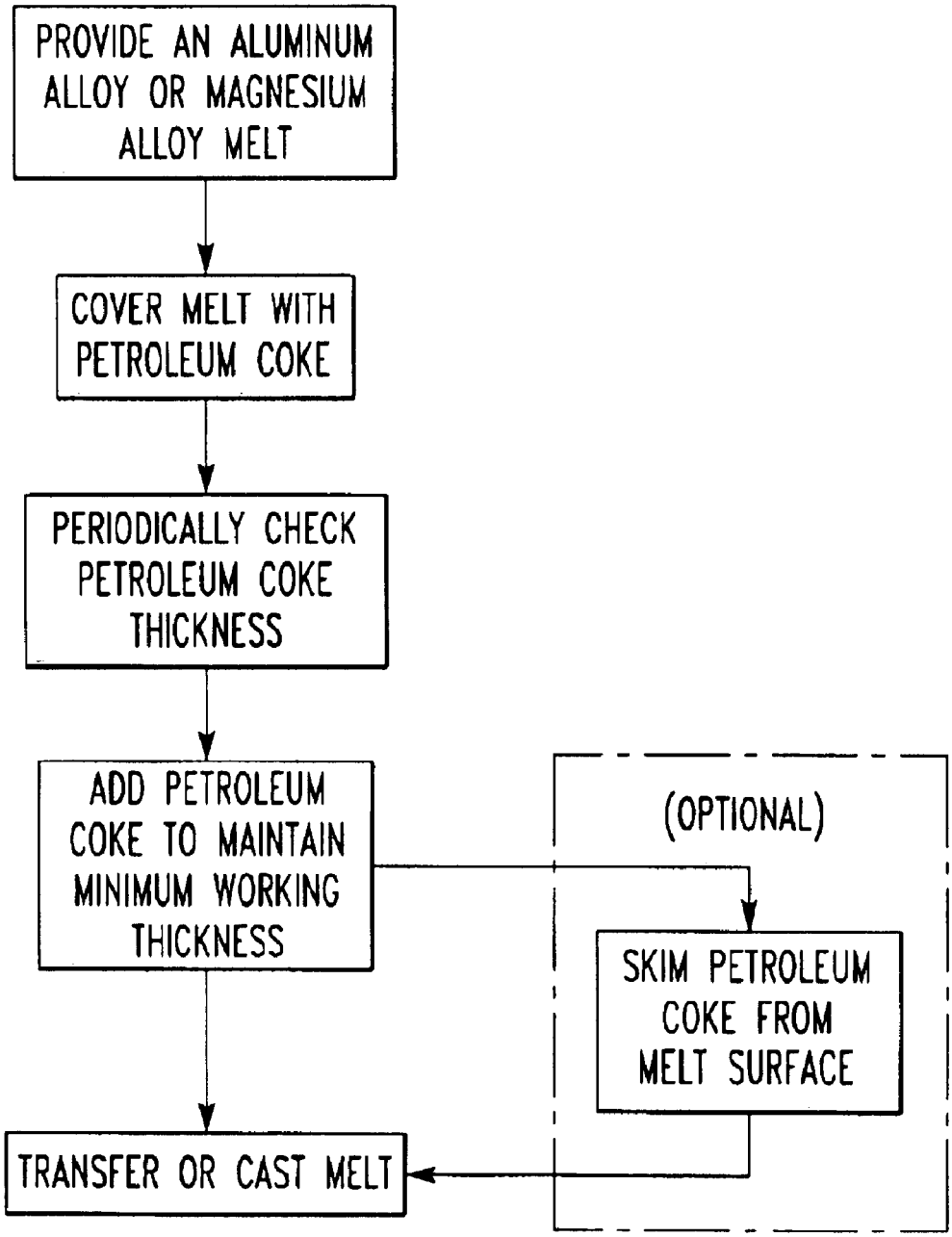
FIG. 1 is a flowchart for minimizing oxidation of aluminum alloy and magnesium alloy melt surfaces according to the present invention.

A preferred method for implementing the present invention is found in the flowchart of FIG. 1. This method includes providing an aluminum alloy or magnesium alloy melt, covering the melt with a petroleum coke layer, maintaining a minimum petroleum coke layer thickness by adding petroleum coke as needed, and transferring or casting the melt. Optionally, and in some instances preferably, the petroleum coke layer is skimmed from the melt surface prior to transfer to another vessel. It is recognized that the petroleum coke layer can be added directly onto a melt surface, or could be added to a solid aluminum alloy or magnesium alloy surface, and subsequently melting the solid aluminum alloy or magnesium alloy.

Figure 2:
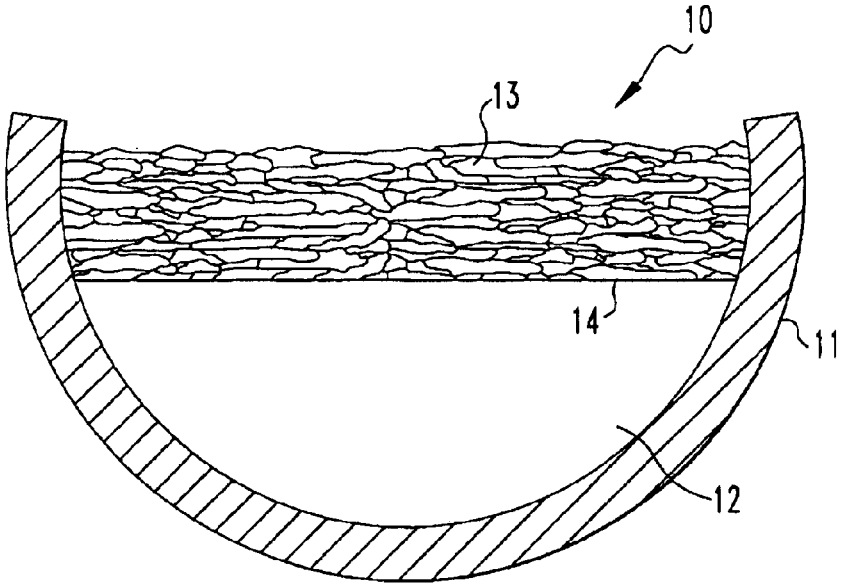
FIG. 2 is a schematic representation of an initial petroleum coke layer on an aluminum alloy and magnesium alloy melt surface in a melting or melt-holding vessel.

Referring now to FIG. 2 the initial state 10 of a preferred embodiment of the method of this invention is presented. A melt holding vessel 11, having an ambient air atmosphere, contains a metallic melt 12. The melt holding vessel 11 can further comprise a means for melting a solid metal, including but not limited to: an indirect gas fired furnace, electric furnace, infrared furnace, and inductively heated furnace. While a direct gas fired furnace can be used, engineering safety systems should be in place to prevent unwanted combustion of the petroleum coke. An initial petroleum coke layer 13 is added to a melt surface 14 to completely cover the melt surface 14 with an initial layer 13 thickness of approximately 0.75–1 inch.

Figure 3:
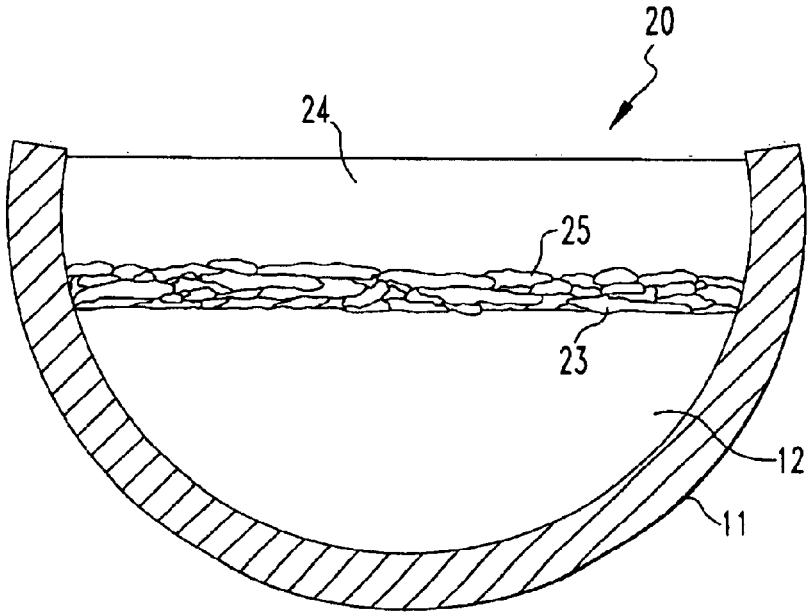
FIG. 3 is a schematic representation of a working petroleum coke layer and inert carbon dioxide layer on an aluminum alloy and magnesium alloy melt surface in a melting or melt-holding vessel.

Referring now to FIG. 2 and FIG. 3, FIG. 3 depicts the working state 20 of the method of this invention. While not intending to be bound by any particular mechanistic theory, it is believed that at typical melt temperatures, in a melt holding vessel 11 with furnaces that are open to ambient air, the initial petroleum coke layer 13 will immediately, in situ, begin to oxidize with oxygen in the furnace air to form a petroleum coke working layer 23 and carbon dioxide gas 24. The carbon dioxide gas 24 partial pressure is highest at the petroleum coke/air interface 25. While the exact partial pressure of carbon dioxide at the petroleum coke/air interface 25 is not determined, it is expected that the carbon dioxide partial pressure is significant enough to limit the amount of oxygen that can diffuse through the carbon dioxide 24 and reach the petroleum coke working layer 23. Diffusion of oxygen molecules from the furnace air through the high partial pressure of carbon dioxide gas 24 to the petroleum coke/air interface 25 becomes arduous. Most of the oxygen that does diffuse through the generated carbon dioxide gas 24 is further inhibited from reaching the melt by being consumed in the reaction with the petroleum coke working layer 23. An equilibrium will be established that governs the rate of petroleum coke consumption and in-situ carbon dioxide generation.

Conceptually, at the point that the petroleum coke plus oxygen/carbon dioxide gas reaction equilibrium is attained and the petroleum coke layer can be referred to as a petroleum coke working layer 25. Practically, a petroleum coke working layer 25 is attained immediately after adding the initial petroleum coke layer 13. The petroleum coke working layer 23 is monitored periodically, and the minimum thickness of the petroleum coke working layer 23 is maintained by adding more petroleum coke. In a preferred embodiment the working layer thickness is maintained in the range of about 0.125 inch to about 5 inch by adding petroleum coke. In a more preferred embodiment the petroleum coke working layer thickness is maintained in the range of about 0.25 inch to about 3 inch by adding petroleum coke. In a most preferred embodiment the petroleum coke working layer thickness is maintained in the range of about 0.5 inch to about 1 inch by adding petroleum coke. Preferably, the petroleum coke layer is checked and maintained about every 6 to 12 hours. More preferably the petroleum coke layer is checked about ever 8 to 10 hours.

Maintaining a petroleum coke working layer 23 is important for the instant invention in that it is not only required for continued generation of a high partial pressure of inert carbon dioxide gas 24 that protects the melt 12 from oxidation, but also for providing a physical barrier that blocks the diffusion of any unreacted oxygen through the working petroleum coke layer 23, further protecting the melt 12 from oxidation.

The invention is particularly useful for molten aluminum, molten magnesium, and alloys of these metals. Aluminum alloys that are suitable for the method of the instant invention, include casting alloys such as those of the 1xx.x, 2xx.x, 3xx.x, 4xx.x, 5xx.x, 7xx.x, 8xx.x and 9xx.x (as designated by The Aluminum Association, Inc., Washington, D.C.). Specific examples of casting alloys that can be used in this invention include, but are not limited to 319.x, 356.x, 357.x, 520.x, and 535.x.

Aluminum-alloys that are suitable for the method of the instant invention, further include wrought aluminum alloys such as those of the 1xxx, 2xxx, 3xxx, 4xxx, 5xxx, 6xxx, 7xxx, and 8xxx series (as designated by The Aluminum Association, Inc., Washington, D.C.). Specific examples of wrought alloys that can be used in this invention include, but are not limited to 5083, 5086, and 5182.

The term "magnesium alloys" refers to alloys in which magnesium is the base metal, or stated otherwise, alloys of which magnesium is the predominant metal by weight. Examples of magnesium alloys that are suitable for the method of this invention include, but are not limited to AM50, AM60, and AZ91 (ASTM designations according to practice B 275).

A problem of "magnesium loss oxidation" is particularly troublesome for aluminum-magnesium alloys. The term "aluminum-magnesium alloys" used herein refers to metallic alloys wherein the predominant metal by weight is aluminum, and to which magnesium is deliberately added as an alloying element to affect mechanical or other properties of the alloy. In these alloys, aluminum is often referred to as the "base metal". To those skilled in the art, aluminum-magnesium alloys often refers specifically to the 5xxx and 5xx.x series of aluminum alloys, in which magnesium is the predominant alloying element.

Figure 4:
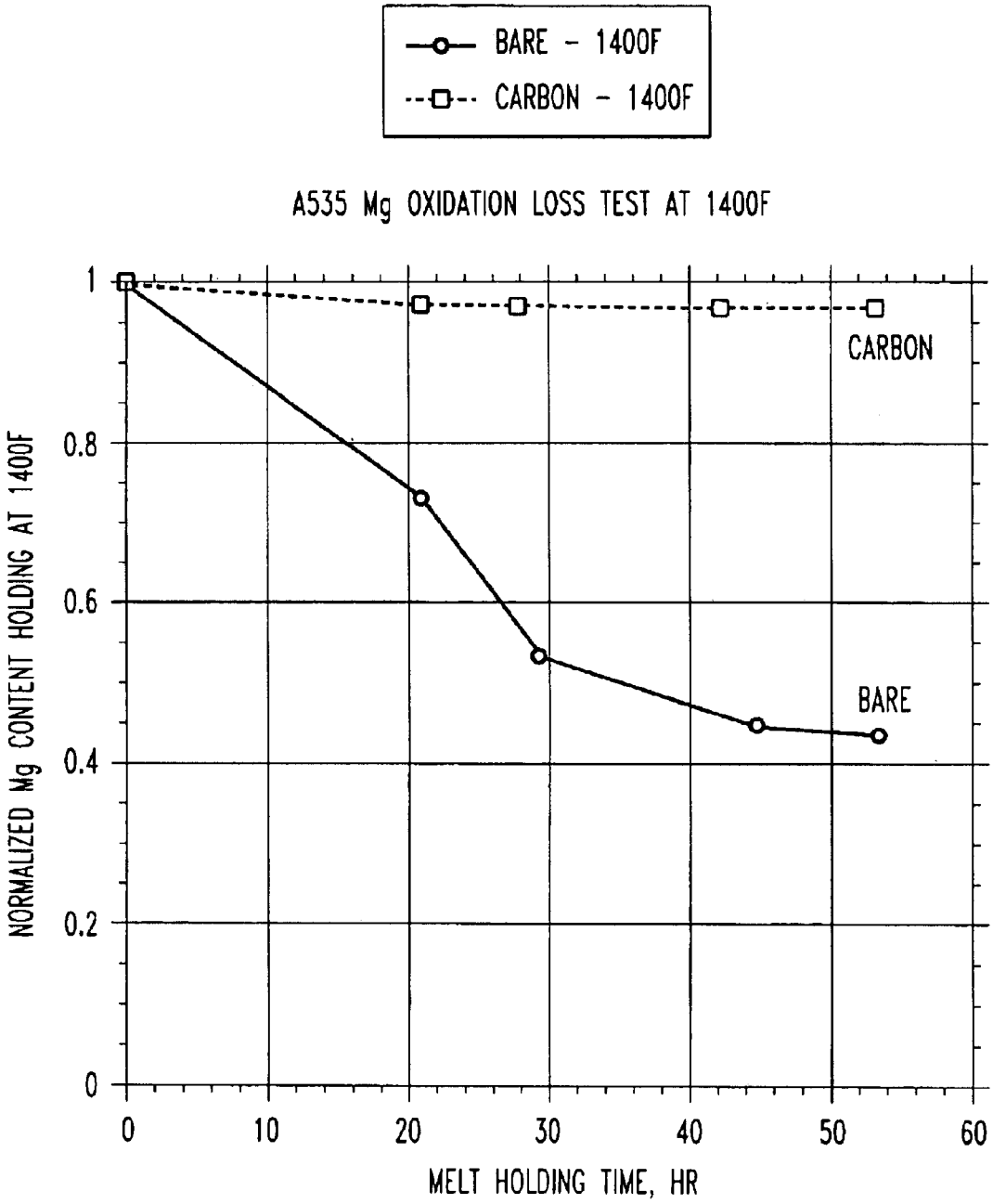
FIG. 4 is a normalized plot of the magnesium content of a 535.x aluminum alloy melt as a function of melt holding time at 1400° F. with and without a petroleum coke melt cover.

Weight losses of magnesium metal due to oxidation in aluminum magnesium alloys can be an insidious problem. Referring to FIG. 4, it is seen that magnesium losses of about 50% (w/w) occur for aluminum-magnesium alloy 535.x after 2 days at 1400° F. (see FIG. 4; plot labeled "bare"). It is further seen in FIG. 4 that a melt having a petroleum coke layer (plot labeled "Carbon") loses less than about 5% (w/w) magnesium under the same conditions as the bare melt.

Figure 5:
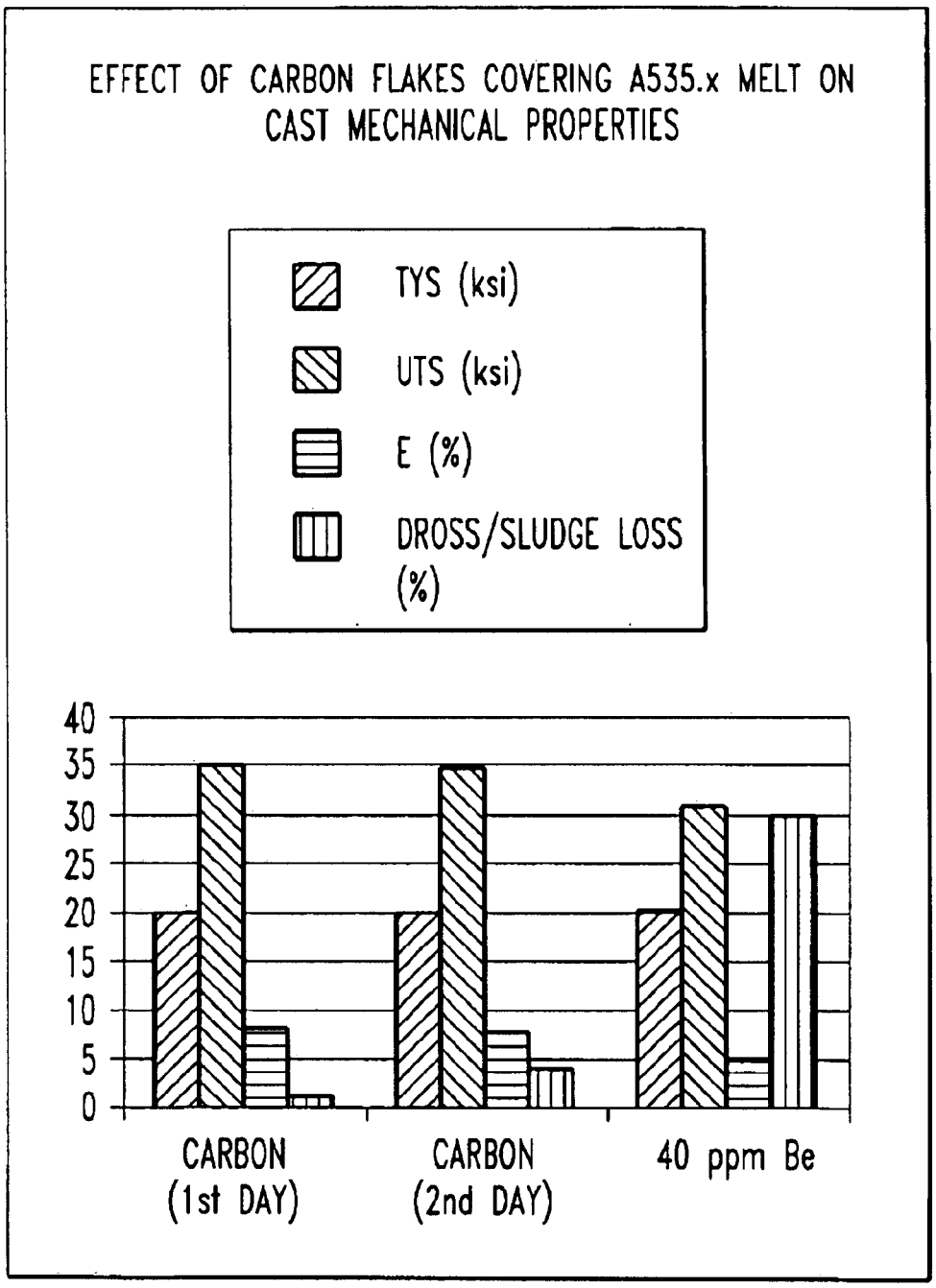
FIG. 5 is a plot of tensile properties of 535.x aluminum alloy castings made from a petroleum coke covered melt that was substantially free of beryllium and from a non-petroleum coke covered melt that contained about 40 ppm beryllium.

Referring now to FIG. 5, it is seen that in addition to minimizing melt surface oxidation and magnesium metal weight loss due to oxidation, the use of the petroleum coke layer as described in this invention yields metallic castings with mechanical properties for aluminum-magnesium alloy castings that are comparable to those obtained by adding small amounts of beryllium to the alloy. The tensile yield strengths (TYS) of A535.x castings, having no beryllium additions, and that were prepared using the petroleum coke layer method of this invention (Carbon) are about 20 ksi, which is essentially identical to the tensile yield strength of the A535.x with about 40 ppm beryllium alloying addition, using no petroleum coke layer. Further from FIG. 5, it is seen that castings prepared from the beryllium-free alloys, utilizing the petroleum coke layer of this invention (Carbon), had about a 4–5 ksi higher ultimate tensile strengths (UTS) than those alloys containing about 40 ppm of beryllium that were prepared without a petroleum coke melt layer. Even further, FIG. 5 shows that loss of metal due to dross and sludge was less than 5% (w/w) for the melts with the petroleum coke layer (Carbon), and was about 30% (w/w) for the 40 ppm beryllium melt without a petroleum coke layer.

Having described the presently preferred embodiments, it is to be understood that the invention may be otherwise embodied within the scope of the appended claims.

What is claimed is:

1. A method for preventing oxidation of molten aluminum alloy surfaces, the method comprising:

a) providing a molten aluminum alloy having a molten aluminum alloy surface;

b) covering the molten aluminum alloy surface with an initial layer of petroleum coke, the initial layer of petroleum coke having an initial layer thickness, c) oxidizing a portion of the initial layer of petroleum coke to form a working layer of petroleum coke covering the molten aluminum alloy surface, the working layer of petroleum coke having a working layer thickness, and a layer of carbon dioxide immediately adjacent to and contiguous with the working layer of petroleum coke; and d) adding additional petroleum coke to the working layer of petroleum coke to maintain the working layer thickness.

2. The method of claim 1, wherein the molten aluminum alloy of (a) is a wrought aluminum alloy.

3. The method of claim 2, wherein the wrought aluminum alloy is selected from the group consisting of 2xxx, 5xxx, 6xxx, and 7xxx series of wrought aluminum alloys.

4. The method of claim 2, wherein the wrought aluminum alloy is selected from 5xxx series of wrought aluminum alloys.

5. The method of claim 2, wherein the wrought aluminum alloy is selected from the group consisting of 5083, 5086, and 5182.

6. The method of claim 1, wherein the molten aluminum alloy of (a) is an aluminum casting alloy.

7. The method of claim 6, wherein the aluminum casting alloy is selected from the group consisting of 2xx.x, 3xx.x, 5xx.x, and 7xx.x series of aluminum casting alloys.

8. The method of claim 7, wherein the aluminum casting alloy is selected from the 5xx.x series of aluminum casting alloys.

9. The method of claim 8, wherein the aluminum casting alloy is selected from the group consisting of 514.x, 515.x, 518.x, 520.x, and 535.x.

10. The method of claim 1, wherein the initial layer thickness of (b) is about 0.125 inch to about 5 inch.

11. The method of claim 1, wherein the initial layer thickness of (b) is about 0.25 inch to about 3 inch.

12. The method of claim 1, wherein the initial layer thickness of (b) is about 0.5 inch to about 1 inch.

13. The method of claim 1, wherein the working layer thickness of (c) is about 0.125 inch to about 5 inch.

14. The method of claim 1, wherein the working layer thickness of (c) is about 0.25 inch to about 3 inch.

15. The method of claim 1, wherein the working layer thickness of (c) is about 0.5 inch to about 1 inch.

16. A method for preventing oxidation of molten magnesium alloy surfaces, the method comprising:

a) providing a molten magnesium alloy having a molten magnesium alloy surface;

b) covering the molten magnesium alloy surface with an initial layer of petroleum coke, the initial layer of petroleum coke having an initial layer thickness, c) oxidizing a portion of the initial layer of petroleum coke to form a working layer of petroleum coke covering the molten magnesium alloy surface, the working layer of petroleum coke having a working layer thickness, and a layer of carbon dioxide immediately adjacent to and contiguous with the working layer of petroleum coke; and d) adding additional petroleum coke to the working layer of petroleum coke to maintain the working layer thickness.

17. The method of claim 16, wherein the magnesium alloy is selected from the group consisting of AMxx, ASxx, and AZxx.

18. The method of claim 16, wherein the initial layer thickness of (b) is about 0.125 inch to about 5 inch.

19. The method of claim 16, wherein the initial layer thickness of (b) is about 0.25 inch to about 3 inch.

20. The method of claim 16, wherein the initial layer thickness of (b) is about 0.5 inch to about 1 inch.

21. The method of claim 16, wherein the working layer thickness of (c) is about 0.125 inch to about 5 inch.

22. The method of claim 16, wherein the working layer thickness of (c) is about 0.25 inch to about 3 inch.

23. The method of claim 16, wherein the working layer thickness of (c) is about 0.5 inch to about 1 inch.

24. A method for preventing oxidation of molten aluminum casting alloy surfaces, the method comprising:

a) providing a molten aluminum casting alloy having a molten aluminum casting alloy surface;

b) covering the molten aluminum casting alloy surface with an initial layer of petroleum coke, the initial layer of petroleum coke having an initial layer thickness of about 0.75 inches;

c) oxidizing a portion of the initial layer of petroleum coke to form a working layer of petroleum coke covering the molten aluminum casting alloy surface, the working layer of coke having a working layer thickness of about 0.5 inches, and a layer of carbon dioxide immediately adjacent to and contiguous with the working layer of petroleum coke; and d) adding additional petroleum coke to the working layer of petroleum coke to maintain the minimum working thickness at about 0.5 inches.

25. The method of claim 24, wherein the aluminum casting alloy of (a) is selected from the group consisting of 2xx.x, 3xx.x, 5xx.x, and 7xx.x series of aluminum casting alloys.

26. The method of claim 25, wherein the aluminum casting alloy is selected from the 5xx.x series of aluminum casting alloys.

27. The method of claim 26, wherein the aluminum casting alloy is selected from the group consisting of 514.x, 515.x, 518.x, 520.x, and 535.x.

28. A method for preventing oxidation of molten 5xx.x aluminum casting alloy surfaces, the method comprising:

a) providing a molten 5xx.x aluminum casting alloy having a molten 5xx.x aluminum casting alloy surface;

b) covering the molten 5xx.x aluminum casting alloy surface with an initial layer of petroleum coke, the initial layer of petroleum coke having an initial layer thickness of about 0.75 inches;

c) oxidizing a portion of the initial layer of petroleum coke to form a working layer of petroleum coke covering the molten 5xx.x aluminum casting alloy surface, the working layer of coke having a working layer thickness of about 0.5 inches, and a layer of carbon dioxide immediately adjacent to and contiguous with the working layer of petroleum coke; and d) adding additional petroleum coke to the working layer of petroleum coke to maintain the minimum working thickness at about 0.5 inches.

29. The method of claim 28, wherein the molten 5xx.x aluminum casting alloy of (a) is selected from the group consisting of 514.x, 515.x, 518.x, 520.x, and 535.x.

30. A method for preventing oxidation of molten 535.x aluminum casting alloy surfaces, the method comprising:

a) providing a molten 535.x aluminum casting alloy having a molten 535.x aluminum casting alloy surface;

b) covering the molten 535.x aluminum casting alloy surface with an initial layer of petroleum coke, the initial layer of petroleum coke having a thickness of about 0.75 inches;

c) oxidizing a portion of the initial layer of petroleum coke to form a working layer of petroleum coke covering the molten 535.x aluminum casting alloy surface, the working layer of coke having a minimum working thickness of about 0.5 inches, and a layer of carbon dioxide immediately adjacent to and contiguous with the working layer of petroleum coke; and d) adding additional petroleum coke to the working layer of petroleum coke to maintain the minimum working thickness at about 0.5 inches.

* * * * *

UNITED STATES PATENT AND TRADEMARK OFFICE

CERTIFICATE OF CORRECTION

PATENT NO. : 6,733,566 B1
DATED : May 11, 2004
INVENTOR(S) : Que-Tsang Fang et al.

It is certified that error appears in the above-identified patent and that said Letters Patent is hereby corrected as shown below:

Title page,
Item [75], Inventors, insert -- Michael Scherbak -- delete “ ”.

Signed and Sealed this

Eighteenth Day of October, 2005

JON W. DUDAS
*Director of the United States Patent and Trademark Office*